US012662956B2

(12) United States Patent
Bhadra et al.

(10) Patent No.: US 12,662,956 B2
(45) Date of Patent: Jun. 23, 2026

(54) PISTON TEMPERATURE MODEL USING A PHYSICS-BASED SPLIT MULTI-MODEL APPROACH

(71) Applicants: ARAMCO SERVICES COMPANY, Houston, TX (US); FCA US LLC, Auburn Hills, MI (US)

(72) Inventors: Kaustav Bhadra, Ann Arbor, MI (US); Andrew Baur, Whitmore Lake, MI (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/978,443

(22) Filed: Dec. 12, 2024

(65) Prior Publication Data

US 2026/0168428 A1 Jun. 18, 2026

(51) Int. Cl.
*F01P 3/08* (2006.01)

(52) U.S. Cl.
CPC ..... *F01P 3/08* (2013.01); *F01P 2025/40* (2013.01); *F01P 2025/60* (2013.01)

(58) Field of Classification Search
CPC ..... F01P 3/08; F01P 2025/40; F01P 2025/60; F02D 35/02; F02D 35/025; F02D 2200/021; F02D 2200/022
See application file for complete search history.

(56) References Cited

U.S. PATENT DOCUMENTS 8,989,989 B2 3/2015 Sczomak et al.
9,816,454 B1 * 11/2017 Anderson ..... F02D 41/402
(Continued)

FOREIGN PATENT DOCUMENTS

CN 103670754 B 1/2017
CN 109282916 A 1/2019
(Continued)

OTHER PUBLICATIONS

H. Cho, et al., "Piston temperature model oriented to control applications in diesel engines," Institute of Mechanical Engineers Part D: Journal of Automobile Engineering, 2018 (9 pages).
(Continued)

*Primary Examiner* — Grant Moubry
(74) *Attorney, Agent, or Firm* — Osha Bergman Watanabe & Burton LLP

(57) ABSTRACT

An engine includes pistons, cylinders, at least one fuel injector, spark plugs, and piston cooling jets. The engine includes an Electronic Control Unit configured to receive an engine oil temperature, current coolant temperature, current spark value, calibrated spark value, current engine speed, and current engine torque. The Electronic Control Unit is configured to determine a non-firing piston temperature, coolant temperature and combustion phase modifier, and firing piston temperature. The Electronic Control Unit outputs a predicted piston temperature. A method includes housing pistons in cylinders, supplying air, injecting fuel, combusting an air-fuel mixture, spraying engine oil, and receiving an engine oil temperature, current coolant temperature, current spark value, calibrated spark value, current engine speed, and current engine torque. The method includes determining a non-firing piston temperature, coolant temperature modifier, combustion phase modifier, firing piston temperature, outputting a predicted piston temperature, and coordinating operations of the fuel injectors and spark plugs.

20 Claims, 12 Drawing Sheets

(56) References Cited

U.S. PATENT DOCUMENTS

| | | | | |
|---|---|---|---|---|
| 10,961,897 | B2 * | 3/2021 | Lee | F01P 7/16 |
| 2009/0119056 | A1 | 5/2009 | Lehner et al. | |
| 2013/0139768 | A1 | 6/2013 | Takemoto | |
| 2017/0159584 | A1 * | 6/2017 | Yamashita | F02D 41/0002 |
| 2017/0350304 | A1 * | 12/2017 | Yamashita | F02F 3/0092 |
| 2018/0252197 | A1 | 9/2018 | Glugla | |
| 2019/0040836 | A1 | 2/2019 | Toyama et al. | |
| 2021/0189993 | A1 | 6/2021 | Goodall et al. | |
| 2023/0220807 | A1 | 7/2023 | Oryoji et al. | |
| 2023/0358185 | A1 | 11/2023 | Thibault et al. | |
| 2024/0401542 | A1 | 12/2024 | Ishii et al. | |
| 2025/0059899 | A1 * | 2/2025 | Oryoji | F01M 1/08 |

FOREIGN PATENT DOCUMENTS

| | | | |
|---|---|---|---|
| DE | 102014219995 | A1 | 4/2016 |
| DE | 102015215364 | A1 | 2/2017 |
| DE | 102013217928 | B4 | 8/2018 |
| DE | 102015007455 | B4 | 10/2018 |
| DE | 112024000426 | T5 | 10/2025 |
| JP | 2013064374 | A | 4/2013 |
| JP | 2020002899 | A | 1/2020 |
| JP | 2022053308 | A | 4/2022 |
| JP | 2023169955 | A | 12/2023 |
| WO | 2023/135679 | A1 | 7/2023 |
| WO | 2024/095395 | A1 | 5/2024 |

OTHER PUBLICATIONS

D. Buono, et al., "Optical Piston Temperature Measurement in an Internal Combustion Engine," SAE International, 2011 (16 pages).

F. I. Valentin, et al., "Development of a Novel Miniature Power Converter for Low-Power Radioisotope Heat Sources: Numerical and Experimental Results," Nuclear Technology, 2021 (15 pages).

International Search Report and Written Opinion issued in Application No. PCT/US2025/058211, mailed on Mar. 30, 2026 (16 pages).

* cited by examiner

| | 500 RPM | 1,000 | 1,500 | 2,000 | 2,500 | 3,000 |
|---|---|---|---|---|---|---|
| 180 Nm | 12.1 | 12.3 | 12.8 | 15.6 | 15.9 | 16.7 |
| 190 | 12.2 | 12.4 | 12.9 | 15.9 | 16.4 | 17.2 |
| 200 | 12.6 | 13.0 | 13.4 | 16.0 | 16.7 | 17.8 |
| 210 | 13.2 | 13.9 | 14.7 | 16.3 | 18.0 | 19.3 |
| 220 | 14.0 | 14.9 | 17.1 | 19.4 | 21.1 | 22.6 |

FIG. 8

PISTON TEMPERATURE MODEL USING A PHYSICS-BASED SPLIT MULTI-MODEL APPROACH

BACKGROUND

New environmental regulations require specific thresholds to be met for pollutants such as carbon monoxide, unburnt hydrocarbons, nitrogen oxides, and particulate matter. Particulate matter is formed in internal combustion engines when fuel impingement occurs on the surface of the piston, which commonly occurs in modern direct injection engines. Fuel impingement can be reduced if the timing of fuel injection is optimized based on the position of the piston in the cylinder. When impingement occurs, the fuel undergoes pyrolysis, forming polycyclic aromatic hydrocarbons which are precursors to soot formation. A cold piston temperature coupled with high fuel impingement may result in high soot formation; however, employing a late fuel injection timing in order to reduce fuel impingement may lead to high carbon monoxide and unburnt hydrocarbon emissions due to insufficient time for fuel air mixing. As a result of this juxtaposition, it is desirable to predict the temperature of the surface of the piston to provide feedback to the engine controller for injection strategy determination and emissions control.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein relate to an engine with pistons configured to be actuated by combustion reactions within the engine. The engine includes cylinders that are each configured to house a corresponding piston to form a containment boundary for a corresponding combustion reaction of the combustion reactions. The engine includes at least one fuel injector configured to inject fuel into the cylinders where the fuel is mixed with air disposed in the cylinders to form an air-fuel mixture. The engine includes spark plugs each configured to ignite the air-fuel mixture in a corresponding cylinder to initiate the combustion reactions. The engine includes piston cooling jets configured to spray engine oil. The engine includes an Electronic Control Unit (ECU) configured to receive an engine oil temperature, a current coolant temperature, a current spark value, a calibrated spark value, a current engine speed, and a current engine torque. The ECU is then configured to determine a non-firing piston temperature for each piston form the engine oil temperature, a coolant temperature modifier from the current coolant temperature, a combustion phase modifier for each piston from the current spark value and the calibrated spark value, and a firing piston temperature for each piston from the current engine speed and current engine torque. The ECU outputs a predicted piston temperature for each piston based on the non-firing piston temperature, the firing piston temperature, the coolant temperature modifier, and the combustion phase modifier. The ECU coordinates operations of the spark plugs and fuel injectors based on the predicted piston temperature.

Embodiments disclosed herein relate to a method including housing pistons in cylinders where each cylinder houses a piston and forms a containment boundary for a corresponding combustion reaction. Air is supplied to the cylinders, mixing with air disposed in the cylinders. Fuel is injected into the cylinders with a fuel injector to mix with the air disposed in the cylinders to form an air-fuel mixture. The air-fuel mixture is combusted using the spark plugs within the cylinders. Engine oil is sprayed with the piston cooling jets onto an exterior of the cylinders. An engine oil temperature, a current coolant temperature, a current spark value, a calibrated spark value, a current engine speed, and a current engine torque are received by the ECU. A non-firing piston temperature is determined from the engine oil temperature with the ECU. A coolant temperature modifier is determined from the current coolant temperature with the ECU. A combustion phase modifier is determined from the current spark value and the calibrated spark value with the ECU. A firing piston temperature is determined from the current engine speed and engine torque with the ECU. A predicted piston temperature is outputted based on the non-firing piston temperature, the firing piston temperature, the coolant temperature modifier, and the combustion phase modifier with the ECU. The operations of the fuel injectors and spark plugs are coordinated by the ECU based on the predicted piston temperature.

Any combinations of the various embodiments and implementations disclosed herein can be used in a further embodiment, consistent with the disclosure. Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

FIG. 8 depicts a lookup table in accordance with one or more embodiments disclosed herein.

DETAILED DESCRIPTION

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element of the invention. In this respect, the term "upper" denotes an element disposed above a corresponding "lower" element in a vertical direction, while the term "lower" conversely describes an element disposed below a corresponding "upper" element in the vertical direction. Similarly, the term "inner" refers to an orientation closer to a center of an object than a corresponding "outer" orientation.

In general, embodiments of this disclosure are related to controlling an engine based on a predicted piston temperature. The piston temperature predicted from the model is used as feedback to the engine controller to control the timing of fuel injection relative to the piston position in the cylinder. The proposed model uses Electronic Control Unit (ECU) parameters for feedback control and can be implemented without the need for additional software sensors.

Figure 1C:
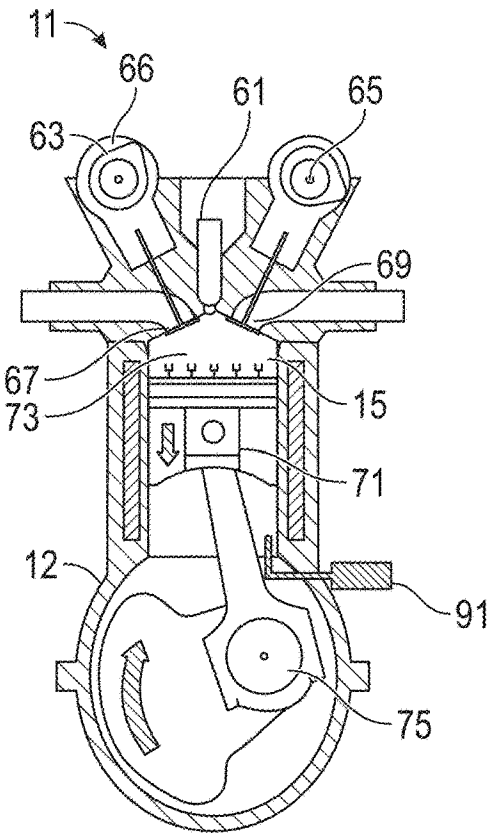
FIGS. 1A-1C depict phases of an engine cycle in accordance with one or more embodiments disclosed herein.
Figure 1B:
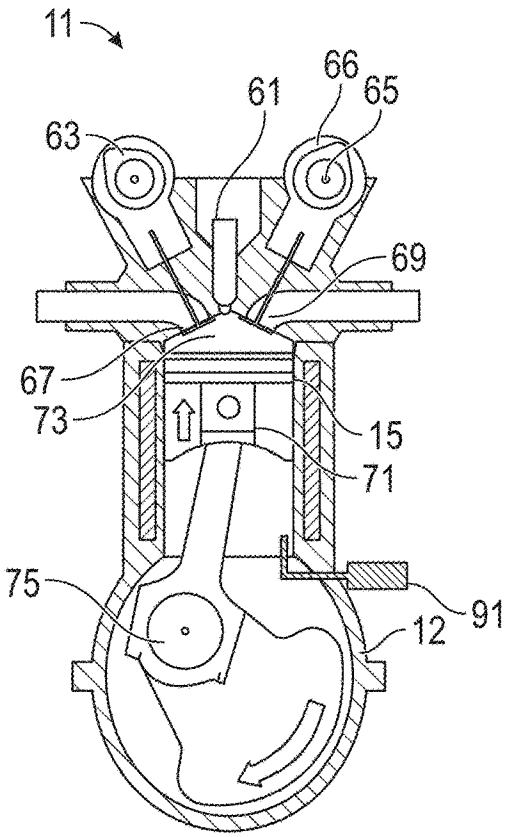
Figure 1A:
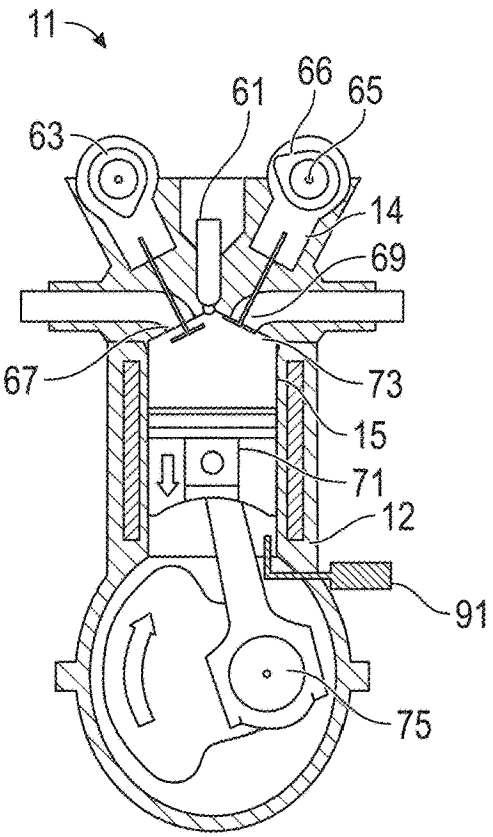

Turning to FIGS. 1A-1C, FIGS. 1A-1C illustrate three steps of the process followed by the engine 11 during a combustion reaction. Specifically, FIG. 1A relates to an intake phase of a combustion reaction, FIG. 1B relates to a compression phase of a combustion reaction, and FIG. 1C relates to a power phase of a combustion reaction. FIGS. 1A-1C each depict a point in time during the operation of a single cylinder 15, such that FIGS. 1A-1C will be replicated for each cylinder 15 per engine cycle.

Turning to the physical structure of each of FIGS. 1A-1C, each of the figures illustrates a close view of a cylinder 15 within an engine 11. The central component of the engine 11 is the engine block 12, which provides a casing structure for mounting various other components of the engine 11 thereto. Typically, the engine block 12 is cast from aluminum or iron, and may be cast in upper and lower pieces. Components such as a cylinder head 14 that contains a camshaft are typically attached to the top of the engine 11, where the cylinder head 14 is sealed with gaskets (not shown) to the engine block 12. As a whole and as discussed further below, the engine block 12 and components connected thereto serve to generate a combustion reaction in a contained manner such that the combustion reaction ultimately generates power via a crankshaft.

The aforementioned combustion reaction is contained in cylinders 15, which are bores formed during the process of casting the engine block 12. The engine 11 may be configured with any number of cylinders 15, with non-limiting examples including four, six, eight, or twelve cylinders disposed in various inline or "V" configurations. Each cylinder 15 is sized and shaped to form a containment boundary for a corresponding combustion reaction. The generation of the combustion reaction within each cylinder 15 is further discussed below. As a whole, the combustion reaction of each cylinder 15 is timed such that the combustion reactions occur in sequence.

Figure 2:
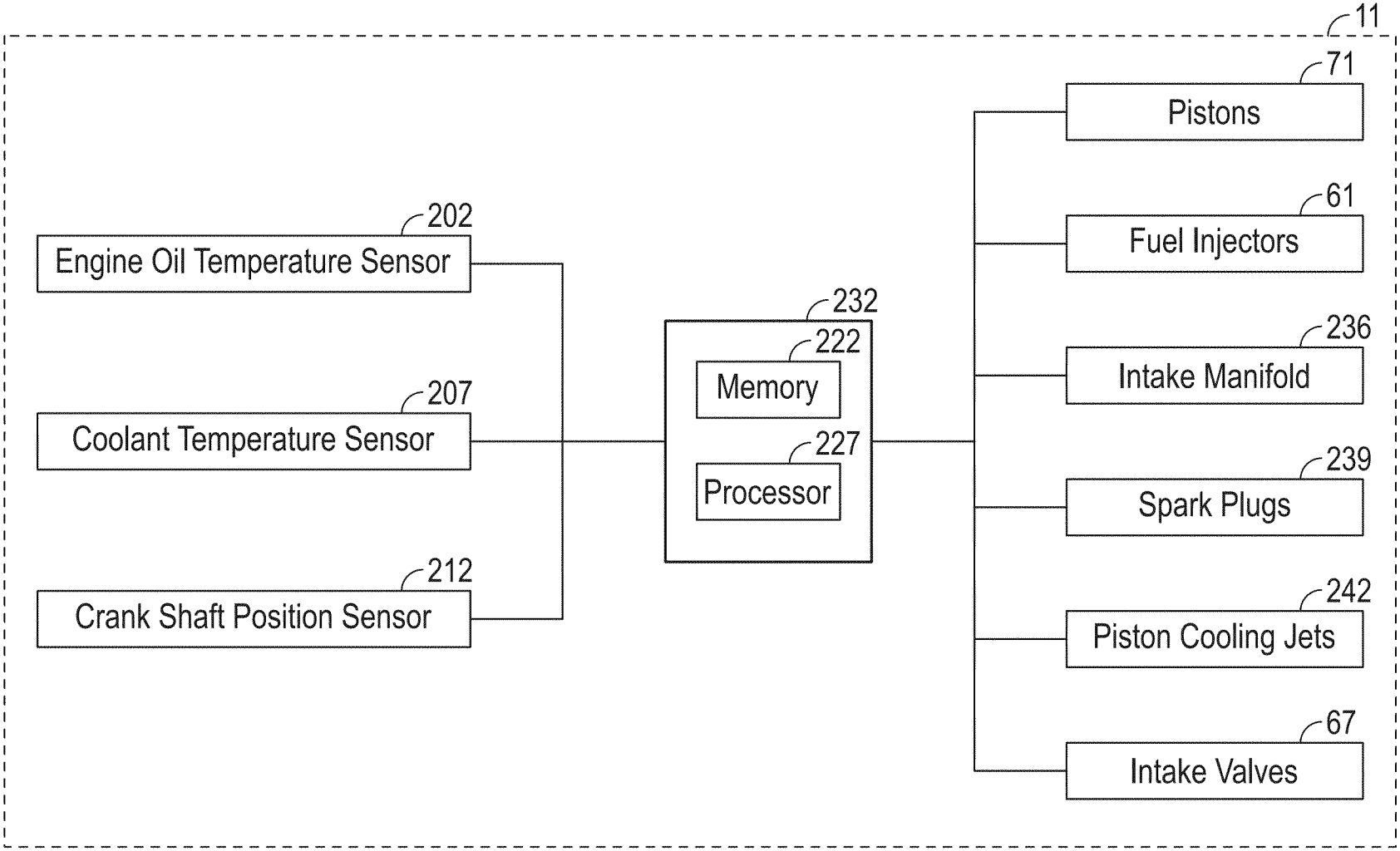
FIG. 2 depicts a block diagram of an engine in accordance with one or more embodiments disclosed herein.

The combustion reaction is generated by compressing air-fuel mixtures in each of the cylinders 15, the process of which is depicted in FIGS. 1A-1C. The air-fuel mixture includes fuel injected into the cylinders 15 and air supplied from an intake manifold (FIG. 2, 236). The fuel portion of the air-fuel mixture is sprayed into the cylinders 15 by at least one fuel injector 61 into a first end of a corresponding cylinder 15, towards the top of the cylinder 15. Fuel is pressurized by way of the high-pressure fuel pump (not shown), which may be embodied as a centrifugal or a positive displacement pump. The air-fuel mixture is compressed by the piston 71 and the spark plugs 239 ignite the air-fuel mixture to initiate the combustion reaction.

As illustrated in FIG. 1A, the engine 11 includes at least one fuel injector 61. The fuel injector 61 is embodied, for example, as an electromagnetically actuated pintle valve that serves to selectively pass fuel from a storage container, such as a fuel tank (not shown), into a corresponding cylinder 15. The actuation of the fuel injector 61 is controlled by the ECU (e.g., FIG. 2) as discussed further below. In addition, the ECU (e.g., FIG. 2) coordinates the operation of each of the fuel injectors 61 in tandem with the other fuel injectors in the other cylinders of a single engine 11 to form a cohesive operation that includes multiple combustion reactions occurring in quick succession.

The engine 11 further includes an intake camshaft 63 and an exhaust camshaft 65. In general, the camshafts 63 and 65 are formed as metal rods that serve to mechanically control the operation of the engine 11 by regulating the introduction and removal of various fluids from the cylinders 15. The camshafts 63 and 65 are aligned so as to extend across each of the cylinders 15, such that a single intake camshaft 63 coordinates the intake operations and a single exhaust camshaft 65 coordinates the exhaust operations of the cylinders 15. Each camshaft includes a plurality of lobes 66 that actuate a corresponding valve of a corresponding cylinder 15. The corresponding valves include, for example, an intake valve 67 that actuates based on the motion of the intake camshaft 63 and an exhaust valve 69 that actuates based on the motion of the exhaust camshaft 65. In the context of FIGS. 1A-1C, the intake valve 67 serves to introduce air into the cylinder 15, where the air may include a compressed air stream from the intake manifold and may include Exhaust Gas Recirculation (EGR) from an EGR line. Similarly, the exhaust valve 69 serves to selectively pass exhaust gases formed by a completed combustion reaction from the cylinders 15 to the exhaust manifold (not shown). The intake valve 67 and the exhaust valve 69 may be formed, for example, from metal and are typically formed with a conical profile that is attached to a tappet. Such a valve is typically referred to as a "poppet" valve in the art.

For its part, the cylinder 15 forms a containment boundary for the combustion reaction to house a piston 71 that is actuated by the combustion reaction. The usable volume within the containment boundary is depicted as a combustion chamber 73, which represents the volume in the engine 11 created by the piston 71 and the cylinder 15. The piston 71 is a solid body, typically formed of metal, that is thrust downwards by the combustion reaction. The piston 71 is mechanically coupled to a crankshaft 75, which performs multiple functions. As a first function, the crankshaft 75 serves to couple the combined actuation of the pistons 71 into a single motion, such that the crankshaft 75 forms a power output shaft of the engine 11. As a second function, the crankshaft 75 provides a point to measure output rotations of the engine 11, such that the position of the crankshaft 75 is related to the timing of operations of the engine 11 as a whole.

The engine also includes multiple piston cooling jets 91 positioned to spray engine oil at the exterior of the cylinder 15, towards the bottom of a piston crown 74, which is located at an opposite end from the first end of the cylinder where the fuel injectors 61 are positioned. The piston cooling jets 91 include at least one oil squirter. These oil squirters cool the piston 71 down to prevent hardware damage when the engine 11 is operated at high loads. FIGS. 1A-1C illustrate both the piston cooling jets and the oil being sprayed.

The various functions of components of the engine 11 are coordinated by the ECU (e.g., FIG. 2). The ECU (e.g., FIG. 2) is formed as one or more processors, integrated circuits, controllers, or a combination thereof that serve to execute computer readable instructions. The ECU (e.g., FIG. 2) may include a memory (e.g., FIG. 2) and a processor (e.g., FIG. 2) that respectively serve to store and execute the computer readable instructions. The computer readable instructions include information regarding the conditions (i.e., timing, engine temperature, pressure, duration, etc.) for actuating a particular component of the engine 11. The ECU (e.g., FIG. 2) is connected to components of the engine 11 by way of a wiring harness (not shown). For its part, the wiring harness is formed as a plurality of wires that form electrical pathways for transmitting signals from the ECU (e.g., FIG. 2) to the various components. Alternatively, or additionally, the wiring harness may be formed by or include circuit boards and printed circuits, among other electronic communication devices.

With the components of FIGS. 1A-1C discussed above, the below paragraphs related to FIGS. 1A-1C discuss time-dependent actions taken by various components of the engine 11 to create the combustion reaction. In relation to FIG. 1A specifically, the intake valve 67 is opened by the intake camshaft 63 to allow the gas mixture to pass from the intake manifold (FIG. 2, 236) to the cylinder 15. A small burst of fuel is sprayed into the combustion chamber 73 by way of the fuel injector, forming an air-fuel mixture. This is further facilitated by the crankshaft 75 being actuated by other combustion reactions in other cylinders 15, causing the piston 71 of FIG. 1A to thrust downward and create a negative pressure in the combustion chamber 73. Accordingly, FIG. 1A corresponds to the intake phase of a four stroke combustion process, as FIG. 1A depicts the air-fuel mixture forming in the cylinder 15. Once the air-fuel mixture is disposed in the combustion chamber 73, the process continues as depicted in FIG. 1B.

In FIG. 1B, the piston 71 is forced upwards by the crankshaft 75 to compress the air-fuel mixture inside of the combustion chamber 73, which is referred to as the "compression" phase of the four stroke combustion process. Similar to the actuation of the piston 71 in FIG. 1A, the crankshaft 75 actuates the piston 71 in FIG. 1B using power siphoned from other power strokes of other cylinders 15. The process of actuating the piston 71 in FIG. 1B is completed when the piston 71 reaches the height of its motion, which is referred to as Top Dead Center (TDC) due to the cylinder 15 being at the top of its travel path. At this point, the process transitions to FIG. 1C, which represents the power phase of the four stroke combustion process.

As shown in FIG. 1C, the power phase includes the auto-ignition of the air-fuel mixture by a spark plug (e.g. FIG. 2). Due to the relatively rapid compression of the air-fuel mixture during the compression phase depicted in FIG. 1B, the combustion chamber 73 has an internal temperature above the combustion temperature of the injected fuel. Thus, the injected fuel auto-ignites upon coming into contact with the heated air and the spark plug (e.g. FIG. 2) firing, and the subsequent rapid expansion causes the piston 71 to actuate downward and transfer its motion to the crankshaft 75. The power phase depicted in FIG. 1C is complete when the piston 71 has substantially reached its lowermost point of motion, which is referred to as Bottom Dead Center (BDC) herein.

Once the power phase of FIG. 1C is complete the process continues to the exhaust phase of the four stroke combustion process. Although not depicted, the exhaust phase follows a similar piston actuation process to FIG. 1B as discussed below. During the exhaust phase, the exhaust camshaft 65 actuates an exhaust valve 69, which creates a fluid passageway between the cylinder 15 and the exhaust manifold. The piston 71 is actuated by the crankshaft 75 during this time to actively force exhaust gases from the cylinders 15 by reducing the volume of the combustion chamber 73. Once the exhaust gases have been removed from the cylinder 15, the four stroke combustion process is complete, and restarts with the intake phase depicted in FIG. 1A.

FIG. 2 depicts a block diagram of various hardware components connected to the ECU 232. As discussed above, the ECU 232 operates to control operations of the fuel injectors 61 and spark plugs 239 based a predicted piston temperature for each piston 71 to control timing of combustion. Thus, FIG. 2 depicts hardware components that feed information or receive instructions from the ECU 232 in order to enable operational control. In this regard, components depicted in FIG. 2 as being connected to the left hand side of the ECU 232 represent sensors that feed information to the ECU 232. Components connected to the right hand side of the ECU 232 represent components that are controlled by the ECU 232 to physically facilitate control of combustion timing. For example, the pistons 71, the fuel injectors 61, the intake manifold 236, the spark plugs 239, the piston cooling jets 242, and the intake valves 67 are all components that are controlled by the ECU 232 to facilitate control of combustion timing. The various components of FIG. 2 are interconnected by way of a wiring harness (not shown), which is a bundle of wires that form electrical pathways between the ECU 232 and the various sensors and components discussed.

For its part, the ECU 57 includes a memory 222 and a processor 227. The processor 227 is formed by one or more processors, integrated circuits, microprocessors, or equivalent computing structures that serve to execute computer readable instructions stored on the memory 222. Thus, the memory 222 includes a non-transitory storage medium such as flash memory, a Hard Disk Drive (HDD), a solid state drive (SSD), a combination thereof, or equivalent storage devices. In relation to the invention as described herein, the memory 222 stores computer readable instructions, executed by the processor 227, that relate to controlling operations of the fuel injectors 61 and spark plugs 239 based a predicted piston temperature for each piston 71 to control timing of combustion.

As shown in FIG. 2, the sensors include an engine oil temperature sensor 202, a coolant temperature sensor 207, and a crank shaft position sensor 212. The engine oil temperature sensor 202 measures the temperature of the oil used to cool the pistons 71. The engine oil temperature sensor 202 may be located in the engine block 12 adjacent to an engine oil filter (not shown). The engine oil temperature sensor 202 may be a thermocouple, Resistance Temperature Detector (RTD), or a thermistor sensor. The coolant temperature sensor 207 measures the current temperature of the coolant circulating through the engine 11 for cooling. The coolant temperature sensor 207 may be a thermostat positioned at the engine coolant outlet that includes a diaphragm outputting a voltage signal corresponding to the temperature of the coolant. The crank shaft position sensor 212 measures the angle of rotation of the crank shaft of the engine 11. The crank shaft position sensor 212 may be one of four types: a magnetic pick-up coil, a Hall-effect sensor, a Magneto-Resistive Element (MRE) sensor, or an optical sensor.

Figure 3:
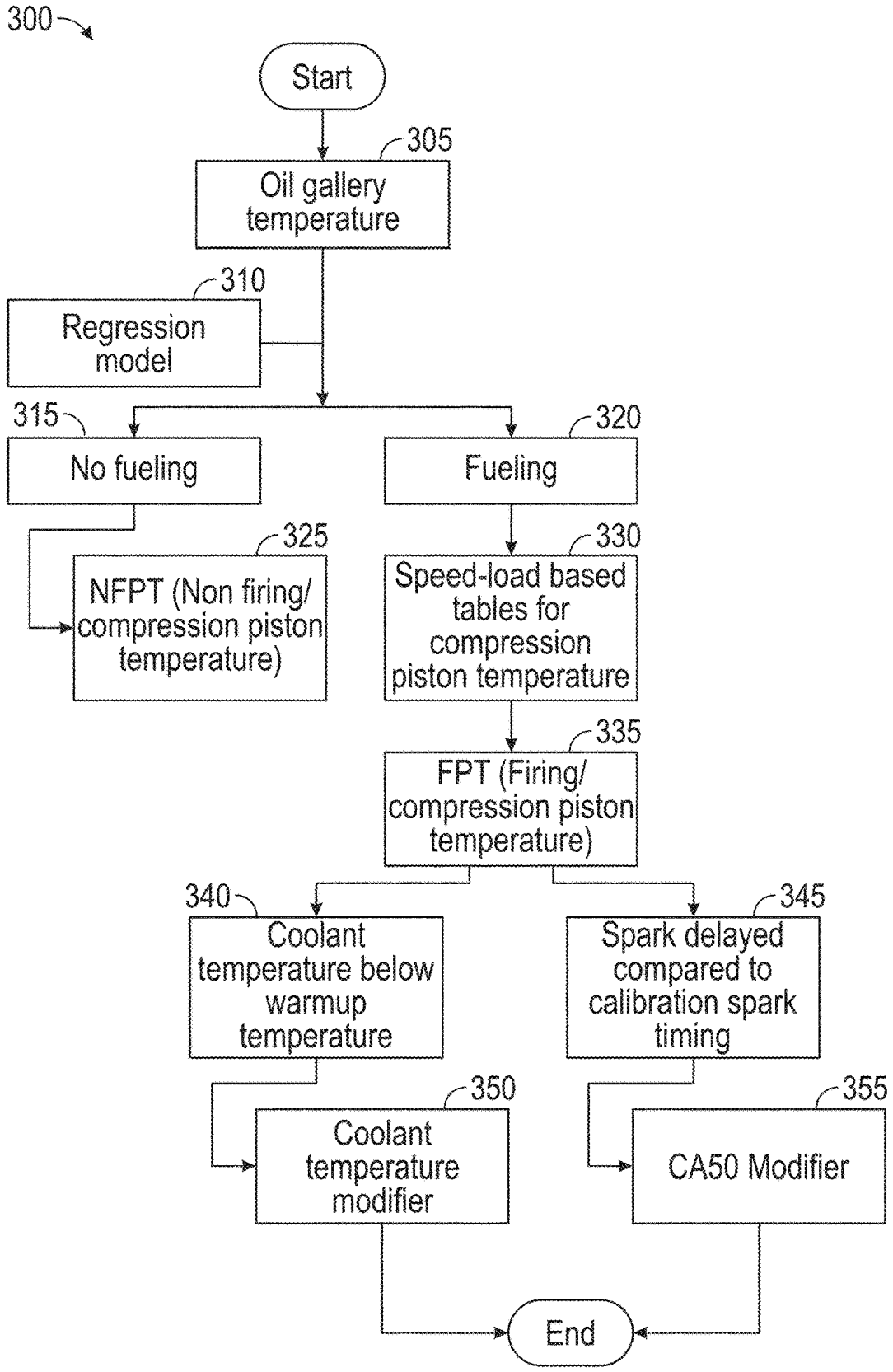
FIG. 3 depicts a piston temperature model flow diagram in accordance with one or more embodiments disclosed herein.

FIG. 3 depicts an overview of a process 300 for determining a piston temperature. The constituent steps of FIG. 3 are described in detail in FIGS. 4-7, and are not described in detail in the discussion of FIG. 3 for the sake of brevity. Briefly, the process 300 initiates with step 305, where the engine oil temperature provides information to the regression model of step 310. At times when fuel is not actively injected into the piston (e.g., during vehicle decelerations when fuel injection is cut off), a no fueling step 315 directs the flow diagram to step 325, a non-firing piston temperature model. At times when fuel is injected into the piston (e.g., during the compression stroke when the vehicle is accelerating), a fueling step 320 directs the flow diagram to step 330, including lookup tables of engine speed and engine load. Using the lookup tables of engine speed and engine load, a firing combustion piston temperature is approximated in step 335. Two additional pathways account for coolant temperature and spark delay. In step 340, the coolant temperature is identified as less than the warm, operational temperature. In step 350, a coolant temperature modifier is calculated based on the current coolant temperature. In step 345, the spark is identified as delayed compared to calibration spark timing. In step 355, a combustion phase modifier 355 is calculated based on the current spark value and the calibrated spark value. To calculate the predicted piston temperature, the values from steps 325 and 335 are added together with the values from steps 350 and 355 subtracted from the summation of steps 325 and 335. The predicted piston temperature represents the temperature across all of the pistons.

Based upon the readings taken from the above-described sensors, the ECU 232 makes several determinations related to the fuel injectors 61, the spark plugs 239, the piston cooling jets 242, and the intake valves 67 in a cohesive manner. Specifically, the ECU determines a non-firing piston temperature for each piston from the engine oil temperature. The ECU determines a current engine speed and current engine torque from the angle of rotation and velocity of the crank shaft of the engine. The ECU determines a coolant temperature modifier from the current coolant temperature. The ECU determines a combustion phase modifier for each piston from the current spark value and the calibrated spark value. The ECU determines a firing piston temperature for each piston from the current engine speed and current engine torque. The ECU outputs a predicted piston temperature for each piston based on the combination of these determined factors, and coordinates the operations, as described above, of the components of the engine. The cohesive operation of the components facilitates optimal combustion timing based on the predicted piston temperature.

Figure 4:
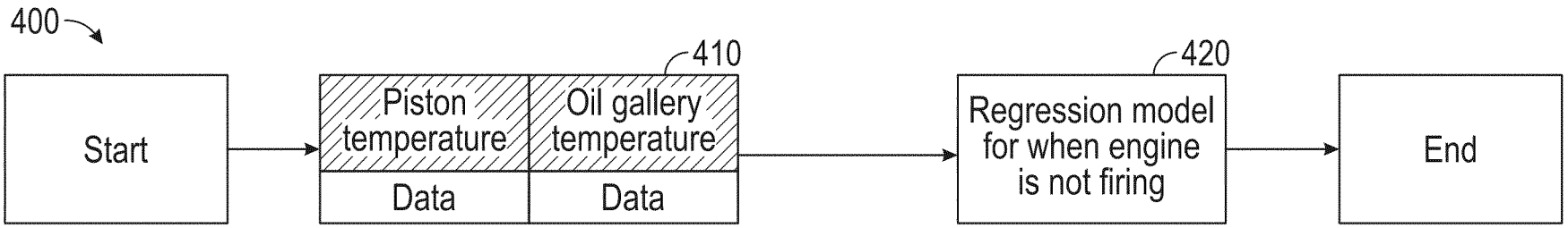
FIG. 4 depicts a regression model flow diagram of the piston temperature model in accordance with one or more embodiments disclosed herein.

FIGS. 4-7 illustrate detailed views of the steps forming the process 300 of FIG. 3. FIG. 4 depicts a regression model 420. The regression model 420 approximates a piston temperature when fuel is not being injected into the cylinders and thus combustion reactions are not occurring, resulting in approximations of a non-firing piston temperature, representing periods when the engine is shut off within the model such as vehicle deceleration or extended idling. In process 400, in step 410, the engine oil temperature is transmitted from the engine oil temperature sensor 202 to the ECU 232. Step 420 represents the generation of the regression model, using the data from the engine oil temperatures and related current piston temperatures, as shown in Equation 1. This regression model correlates the non-firing piston temperature (NFPT) to the engine oil temperature. After the non-firing piston temperature (NFPT) is determined in step 420, the model proceeds to step 320 to determine the firing contribution to piston temperature. The provided equation is one hypothetical example derived from a specific production engine, and the slope and y-intercept values may change based on engine structure.

$$NFPT = 0.98 * (\text{Engine Oil Temperature}) + 9.62 \quad (1)$$

Figure 5:
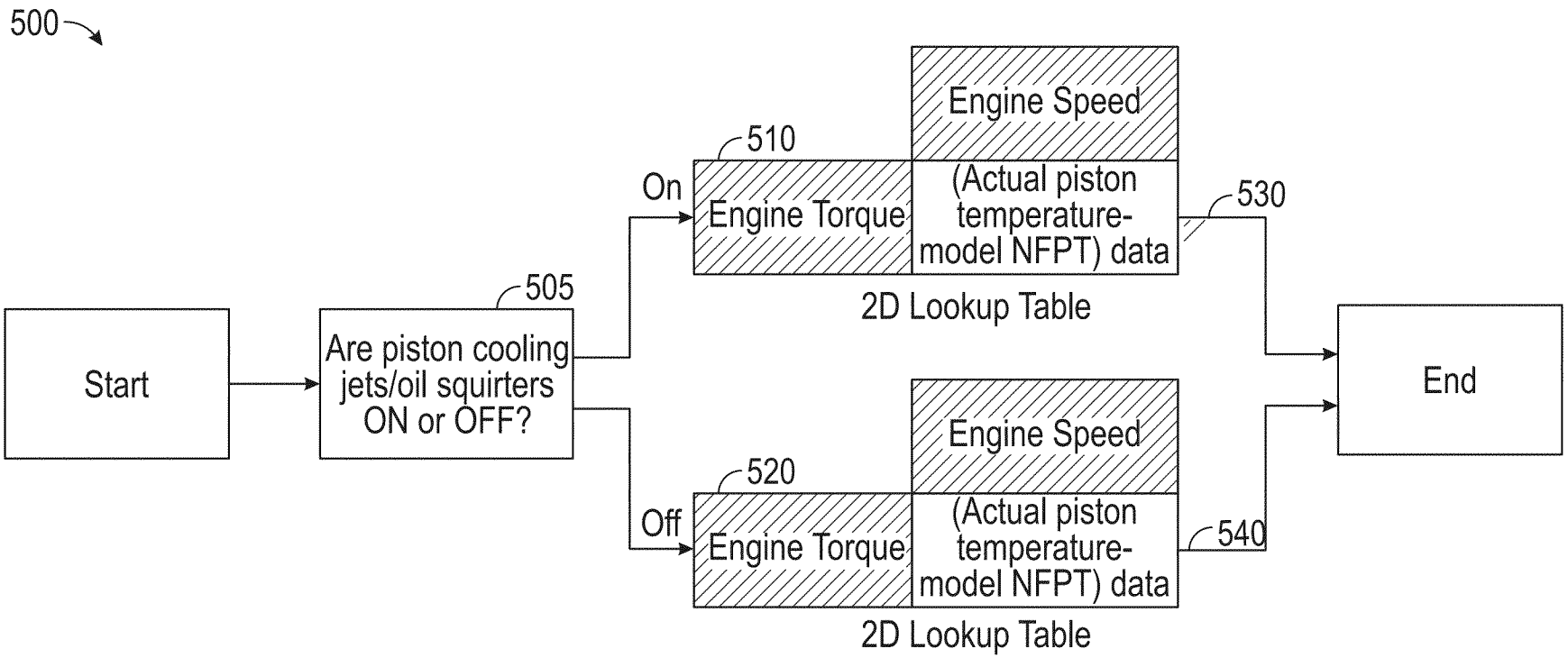
FIG. 5 depicts a firing piston temperature flow diagram of the piston temperature model in accordance with one or more embodiments disclosed herein.

Turning to FIG. 5, FIG. 5 depicts an approximation for a firing contribution to piston temperature. In other words, the approximation represents the contribution to piston temperature that occurs when fuel is injected and combustion reactions occur. In process 500, in step 505, initially the ECU determines whether piston cooling jets are activated. When it is determined that the piston cooling jets are on, the process proceeds to step 510. In step 510, a lookup table is utilized with inputs of engine speed values and engine torque values. The engine torque values may be based on an existing torque model in the ECU software. A crankshaft position sensor 212 transmits the engine speed to the ECU 232, allowing for engine torque to be determined within the ECU 232. The lookup table data captures the difference between the total current piston temperature and the non-firing piston temperature, referred to as the firing piston temperature herein. In step 530, the firing piston temperature is determined from lookup tables including data on engine speed and engine torque. When it is determined that the piston cooling jets are off, the process proceeds to step 520. In step 520, a lookup table is utilized with inputs of engine speed values and engine torque values. The lookup table data captures the difference between the total current piston temperature and the non-firing piston temperature, referred to as the firing piston temperature. In step 540, the firing piston temperature is determined from look up tables containing data on engine speed and torque. After the firing piston temperature is determined in steps 530 or 540, the model proceeds to steps 340 and 345 to determine coolant temperature and spark values.

Figure 6:
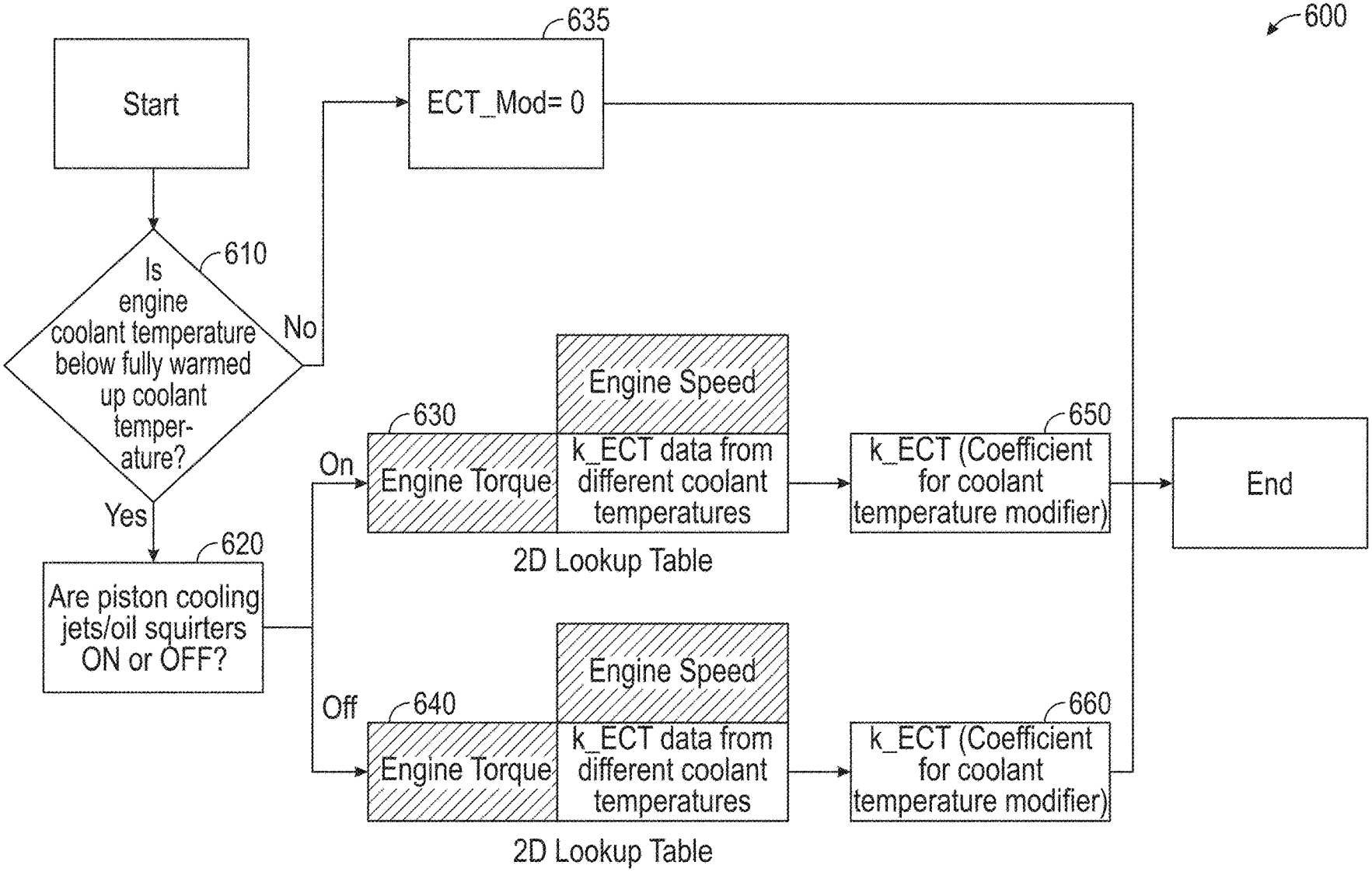
FIG. 6 depicts a coolant temperature modifier flow diagram of the piston temperature model in accordance with one or more embodiments disclosed herein.

FIG. 6 depicts an approximation for a coolant temperature modifier ($FCT_{Mod}$) for the piston temperature. In other words, a coolant temperature modifier term ($FCT_{Mod}$) is necessary to account for any changes to piston temperature caused by the engine coolant heating up during cold start conditions. The coolant temperature modifier ($ECT_{Mod}$) is represented by a coolant temperature coefficient ($k_{ECT}$) multiplied by a differential coolant temperature, as shown in Equation 2. The differential coolant temperature is the difference between the coolant temperature threshold and the current coolant temperature.

$$ECT_{Mod} = k_{ECT} * \text{(Coolant Temperature Threshold} - \text{Current Coolant Temperature)} \quad (2)$$

In process 600, step 610 initiates by determining whether the current coolant temperature is below a coolant temperature threshold. In experimentation, the coolant temperature threshold was set to 90° C. The coolant temperature threshold is equivalent to the temperature of the coolant when the coolant is fully warmed up to operational temperatures, and is determined and set by a system engineer or operator. If the current coolant temperature is not below the coolant temperature threshold, then the process 600 progresses to step 635, where the coolant temperature modifier is equal to zero. In other words, once the engine coolant is fully warmed up to operational temperatures, the coolant temperature modifier term ($ECT_{Mod}$) drops out and does not impact the predicted piston temperature. If the current coolant temperature is below the coolant temperature threshold, the process 600 progresses to step 620 where the ECU determines whether the piston cooling jets are on or off. If the piston cooling jets are on, the process 600 progresses to step 630. In step 630, a lookup table is utilized with inputs of engine speed values and engine torque values. A coefficient for the coolant temperature modifier term ($k_{ECT}$) is retrieved from the lookup table. In step 650, the coolant temperature modifier ($ECT_{Mod}$) is calculated using the coefficient for the coolant temperature modifier. If the piston cooling jets are off, the process 600 progresses to step 640. In step 640, a lookup table is utilized with inputs of engine speed values and engine torque values. A coefficient for the coolant temperature modifier term ($k_{ECT}$) is retrieved from the lookup table. In step 660, the coolant temperature modifier ($ECT_{Mod}$) is calculated using the coefficient for the coolant temperature modifier ($k_{ECT}$) and the differential coolant temperature. After the coolant temperature modifier is determined in step 660, the model proceeds to step 355 to determine the combustion phase modifier.

Figure 7:
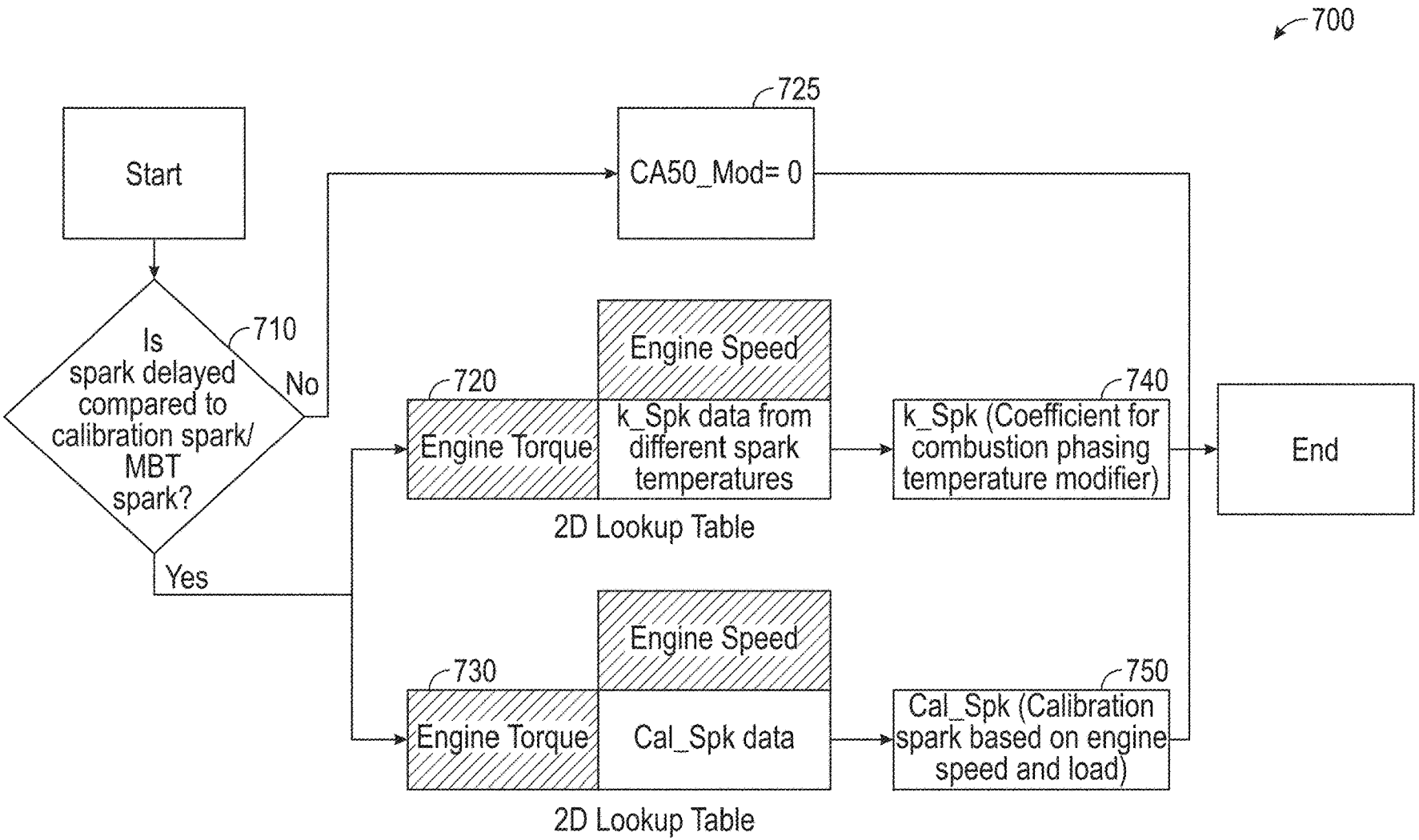
FIG. 7 depicts a combustion phasing modifier flow diagram of the piston temperature model in accordance with one or more embodiments disclosed herein.

FIG. 7 depicts an approximation for a combustion phase modifier ($CA50_{mod}$) for the piston temperature. In other words, a combustion phase modifier term ($CA50_{mod}$) is necessary to account for reductions in piston temperature caused when the combustion phasing is delayed with spark timing to control knock. In the context of this disclosure, the phrase "combustion phasing" refers to a time at which combustion occurs, and is equivalent to the time at which a spark is generated by a spark plug 239 during the four stroke engine cycle. As combustion phasing is delayed, there is lesser residence time available for heat transfer from the exhaust gases to the piston. A large portion of the exhaust enthalpy leaves the combustion chamber, leading to reductions in piston temperature. The combustion phase modifier ($CA50_{mod}$) is represented by a spark coefficient ($k_{spk}$) multiplied by a differential spark value, as shown in Equation 3. The differential spark value is the difference between a calibrated spark value and a current spark value.

$$CA50_{Mod} = k_{Spk} * \text{(Calibrated Spark Value} - \text{Current Spark Value)} \quad (3)$$

In process 700, step 710 initiates by determining whether the current spark value is less than the calibrated spark value, indicating a delay in the spark timing. If there is no delay and the current spark value and the calibrated spark value are the same, the process 700 progresses to step 725. In step 725, the combustion phase modifier is equal to zero. If there is a delay and the current spark value and the calibrated spark value are different, the process 700 progresses to two parallel pathways of step 720 and step 730. In step 720, a lookup table is utilized with inputs of engine speed values and engine torque values. In step 710, a current calibrated spark value is compared to the current ECU issued spark value. A coefficient for the combustion phase modifier term is retrieved from the lookup table, which was created with data collected at a variety of spark timings. In step 730, a lookup table is utilized with inputs of engine speed values and engine torque values. Step 730 relies on obtaining a new calibrated spark value to compare to the current ECU issued spark value. A coefficient for the combustion phase modifier term is retrieved from the lookup table at a variety of spark timings. In step 740, the combustion phase modifier is calculated from the coefficient for the combustion phase modifier and the differential spark value. In step 750, the combustion phase modifier is calculated from the coefficient for the combustion phase modifier and the differential spark value.

Each of FIGS. 4-7 provides a term for the following Equation 4:

$$\text{Overall Predicted Piston Temperature} = NFPT + FPT - ECT_{Mod} - CA50_{Mod} \quad (4)$$

As discussed in greater detail above, FIG. 4 provides the non-firing piston temperature term (NFPT). FIG. 5 provides the firing piston temperature term (FPT). FIG. 6 provides the coolant temperature modifier term ($ECT_{Mod}$). FIG. 7 provides the combustion phase modifier term ($CA50_{Mod}$). In combination, these terms allow for a predicted piston temperature.

FIG. 8 shows an example of a lookup table for illustrative purposes only. In FIG. 8, the look up table is based on engine torque and engine speed and shows relevant spark values in units of degrees. For each of the processes described above that relies upon a lookup table, a similarly structured lookup table is utilized providing desired values for given engine torques and engine speeds.

Figure 9A:
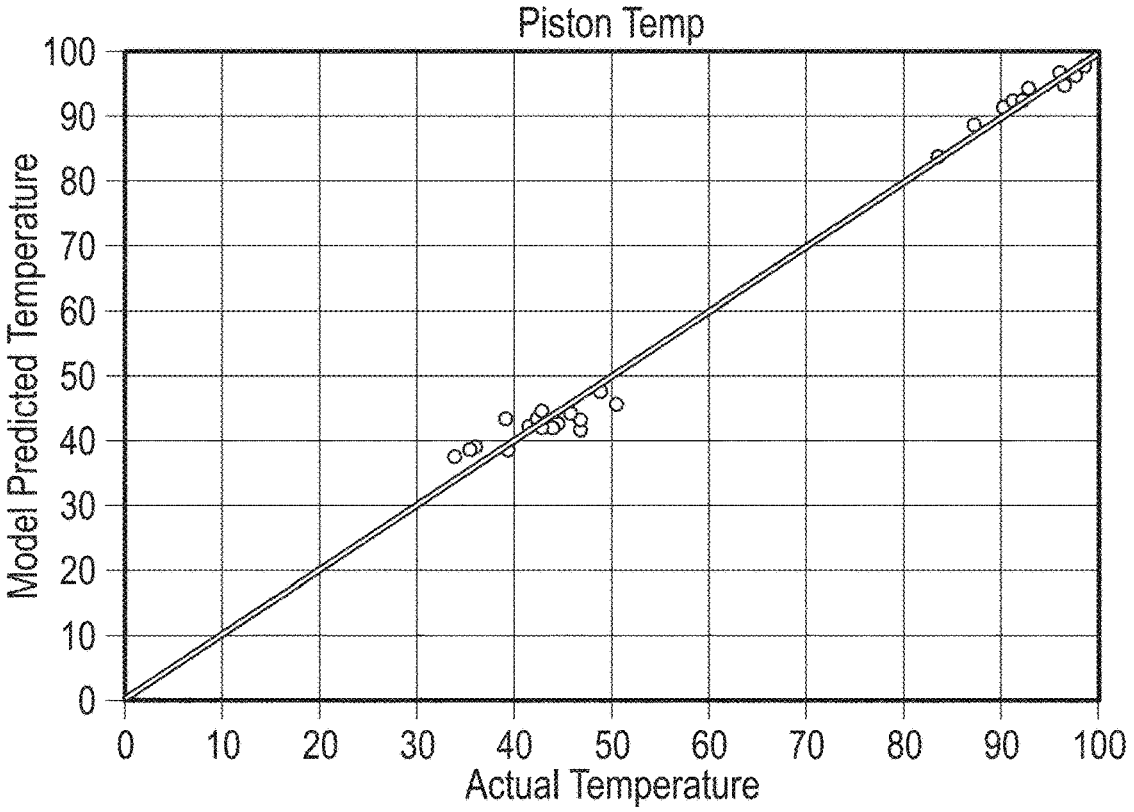
FIGS. 9A and 9B are graphs of predicted non-firing piston temperature and associated error in accordance with one or more embodiments disclosed herein.
Figure 9B:
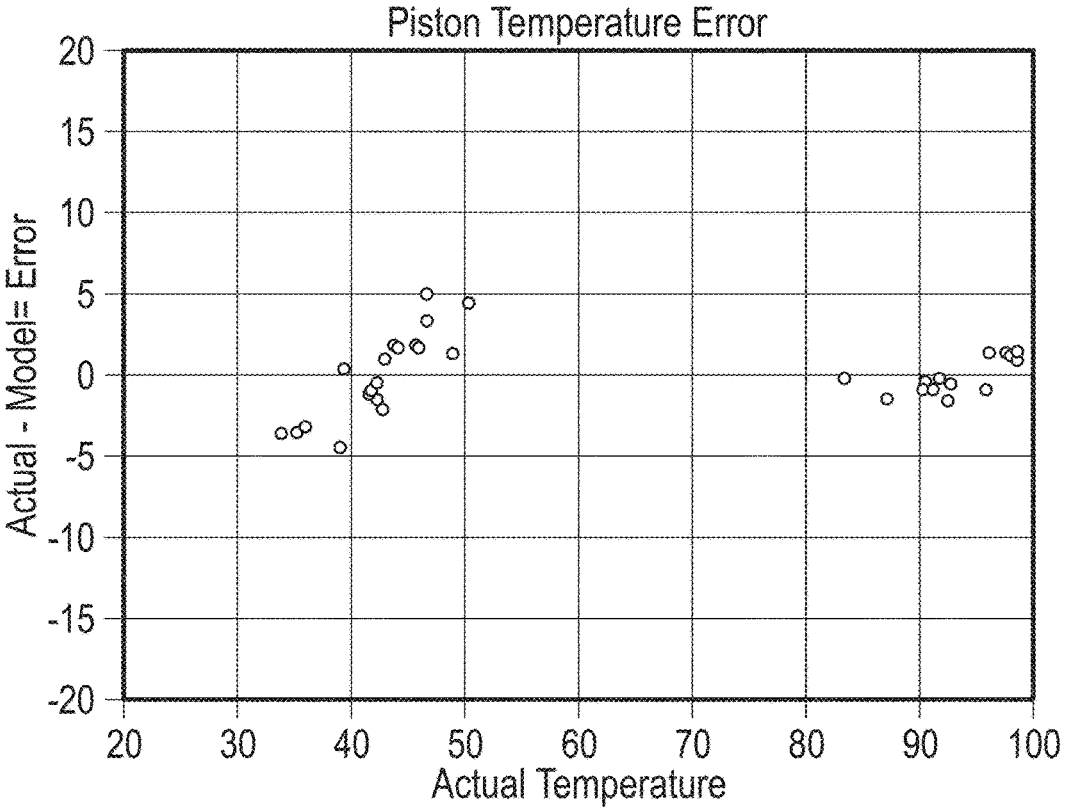

Turning to FIGS. 9A-9B, the regression model for calculating the non-firing piston temperature is shown. These figures include data derived from a dynamometer and as such are based on a specific engine configuration. Accordingly, measurements may vary based on the specific engine design utilized. FIG. 9A shows the predicted non-firing piston temperature against the actual piston temperature (validation assessment). The majority of the model predicted temperatures are grouped around 40° C. and 90° C., which were the cold start and warmed up temperatures utilized. Using data points shown on the graph in combination with linear regression, the line on the graph represents the regression model generated by the data. FIG. 9B illustrates the error associated with the resulting regression model, which is minimal as most of the points fall relatively close to 0, with a minimum of approximately −4.5 and a maximum of 5. As mentioned above, as the data was derived from a dynamometer on a specific engine configuration, these values may vary for each engine configuration.

Figure 10A:
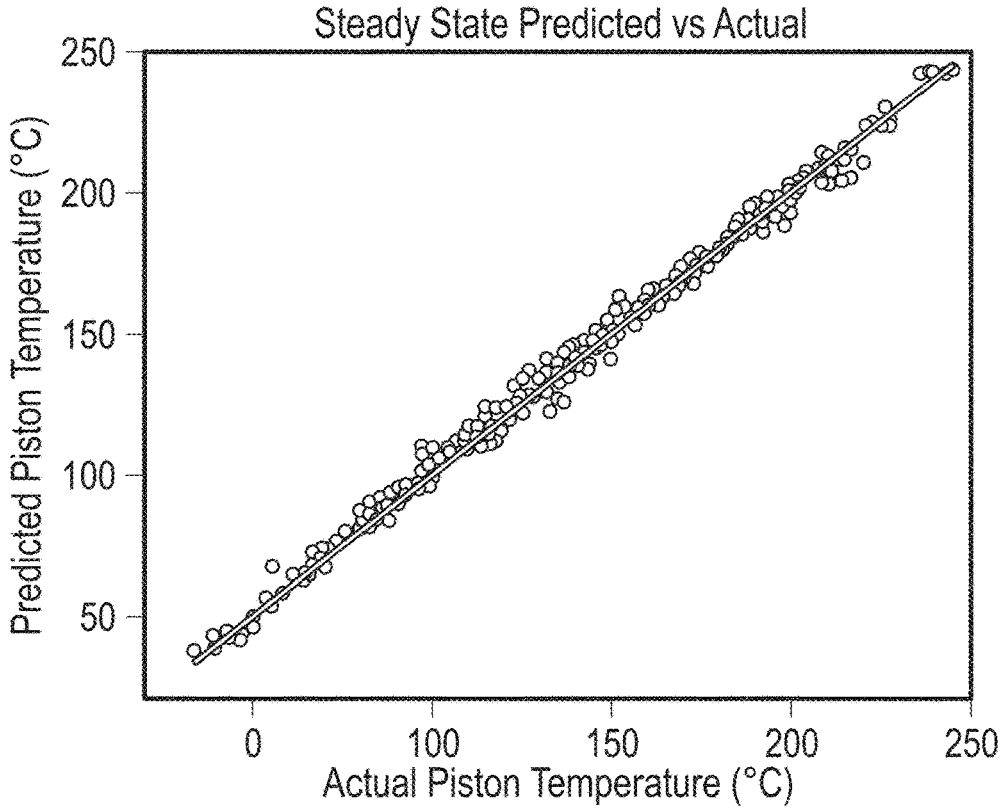
FIGS. 10A and 10B are graphs of predicted piston temperature and error in accordance with one or more embodiments disclosed herein.
Figure 10B:
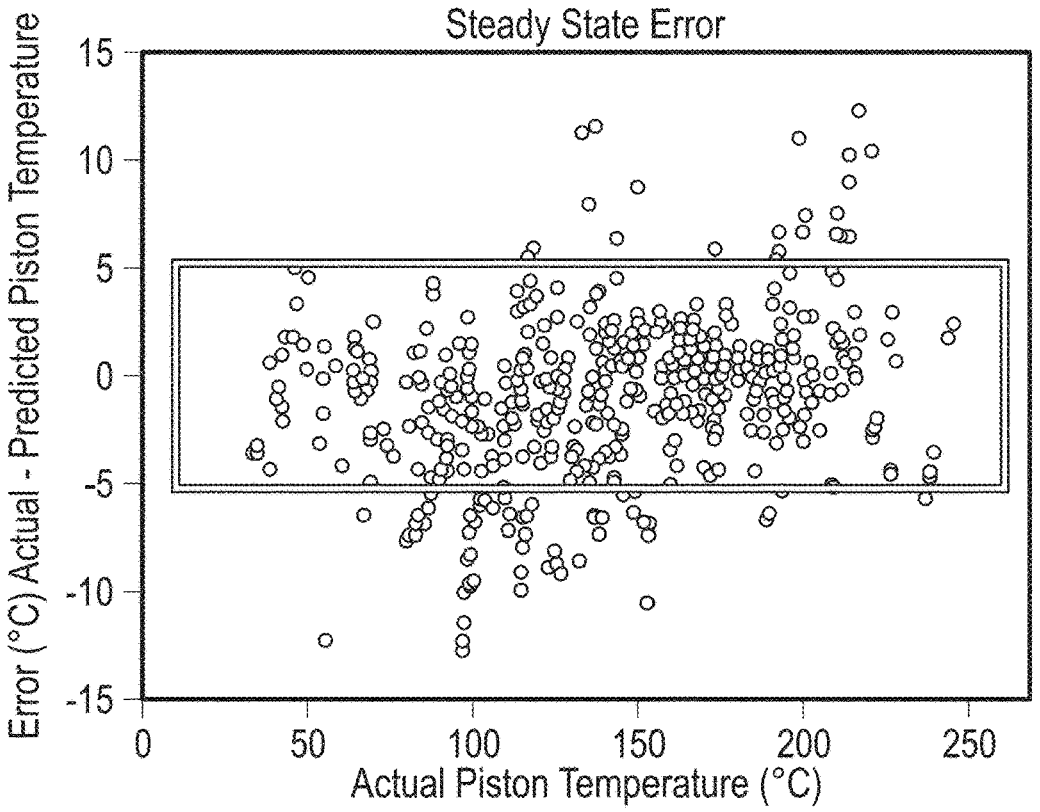

FIGS. 10A and 10B show validation assessments of the overall piston temperature model. These figures include data derived from a dynamometer and as such are based on a specific engine configuration. Accordingly, measurements may vary based on the specific engine design utilized. The points in FIG. 10A represent data points collected in steady state experiments. The line represents the linear line showcasing how far off the predicted values are compared to the actual values and indicates that the overall model accurately predicts the piston temperature from the steady state experiments. FIG. 10B illustrates the error associated with the model from the data collected from steady state experiments, with most of the points falling relatively close to 0, and a minimum of approximately −13 and a maximum of approximately 13. As mentioned above, as the data was derived from a dynamometer on a specific engine configuration, these values may vary for each engine configuration.

Figure 11A:
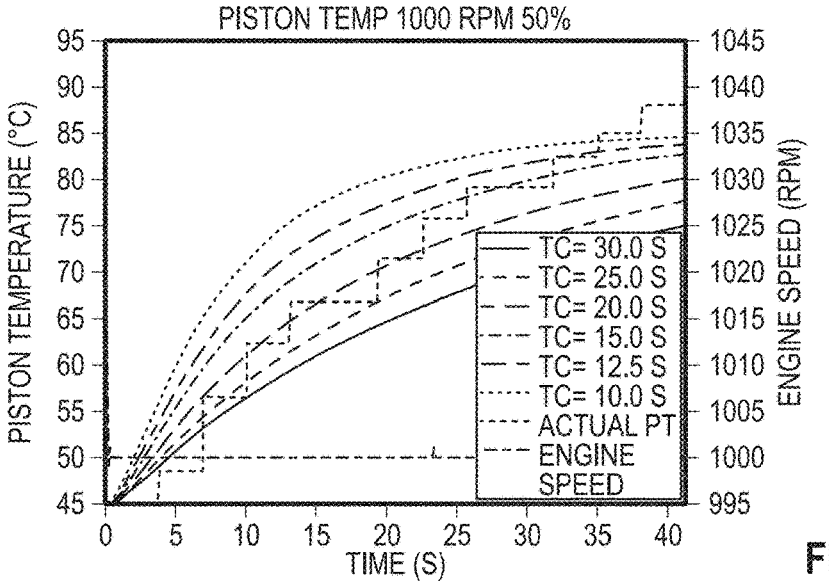
FIGS. 11A-11C are graphs of predicted piston temperature using various time constants at different engine speeds in accordance with one or more embodiments disclosed herein.
Figure 11B:
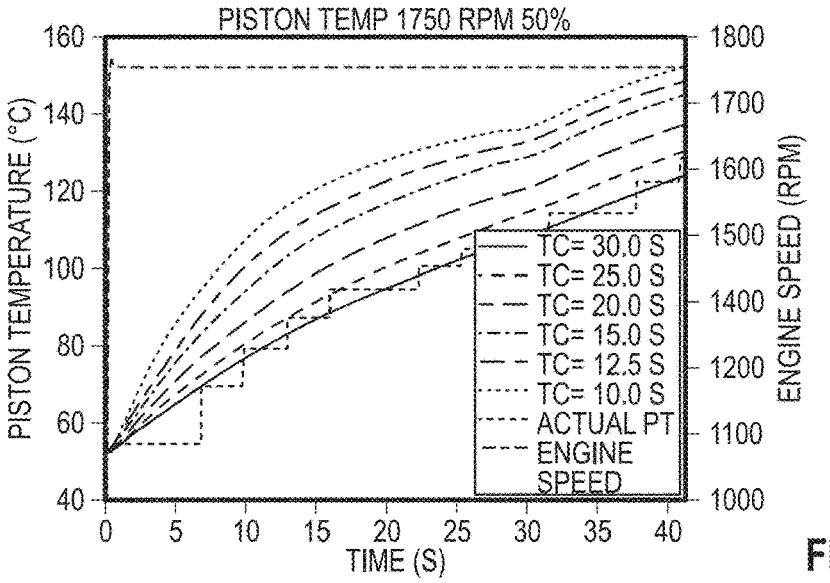
Figure 11C:
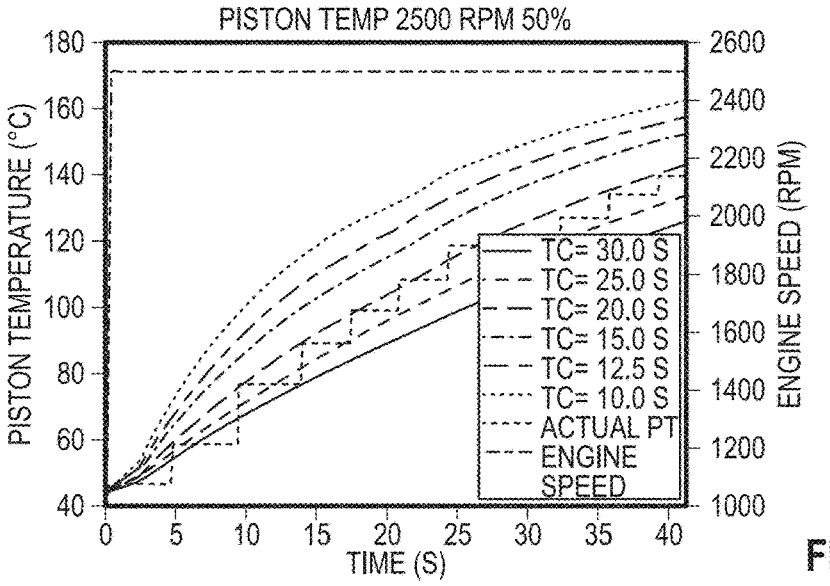

FIGS. 11A-11C show the predicted piston temperature against time for various engine speeds. These figures include data derived from a dynamometer and as such are based on a specific engine configuration. Accordingly, measurements may vary based on the specific engine design utilized. FIG. 11A shows the graphs for 1000 rpm. FIG. 11B shows the graphs for 1750 rpm. In all of FIGS. 11A-11C, the graphs follow similar trends of temperatures increasing logarithmically with time, with higher temperatures at lower time constant values as the lower time constants impact the rise rate of the modeled piston temperature. The determination of which time constant is selected is a function of computational efficiency and model accuracy. The different time constants represent response speeds for the model. Selecting a low time constant provides higher model granularity during short term modeling conditions at the cost of sacrificing model efficiency. On the other hand, high value time constants offer computational efficiency benefits, but the lack of model iterations may reduce model accuracy. Summarily, the time constant should be selected and adapted by the model based on the various design factors as will be appreciated by a person having ordinary skill in the art, where the design factors include, but are not limited to: engine speed, computer processing power, processor speed, desired model accuracy and efficiency, and similar constraints. In one or more embodiments, a time constant of 12.5 seconds may be optimal to most closely resemble the actual piston temperature data.

Figure 12A:
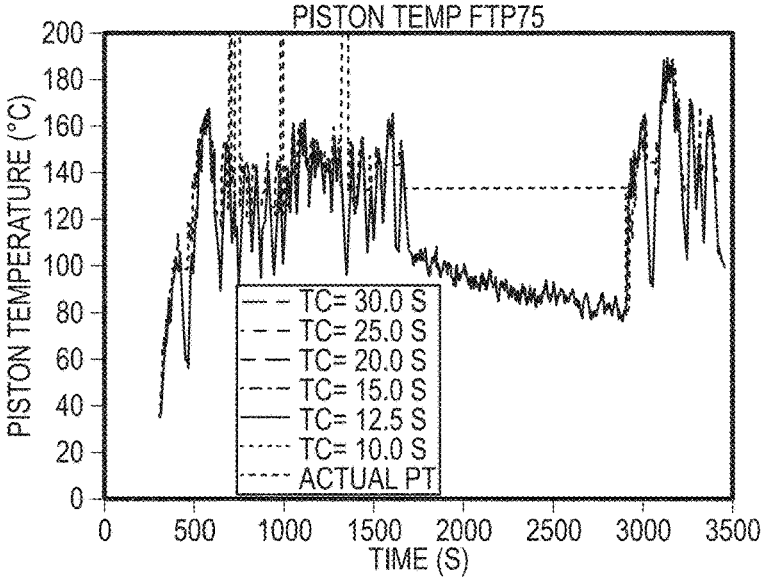
FIGS. 12A-12C are graphs of predicted piston temperature using various time constants in accordance with one or more embodiments disclosed herein.
Figure 12B:
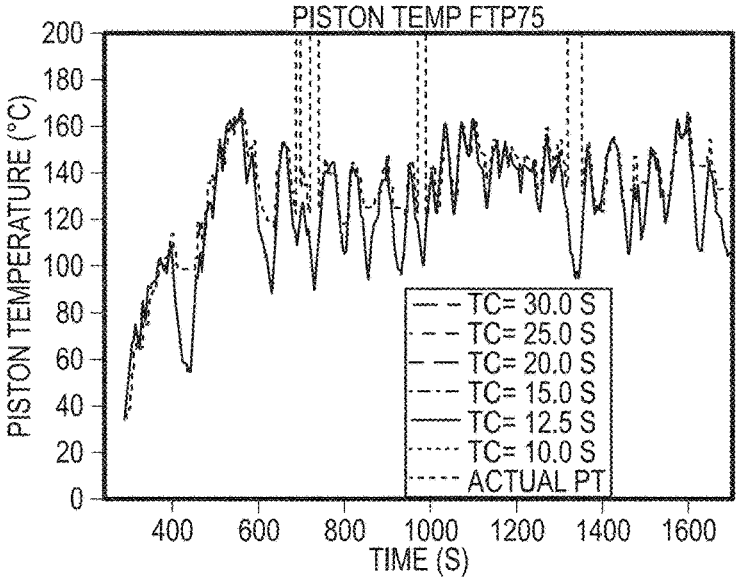
Figure 12C:
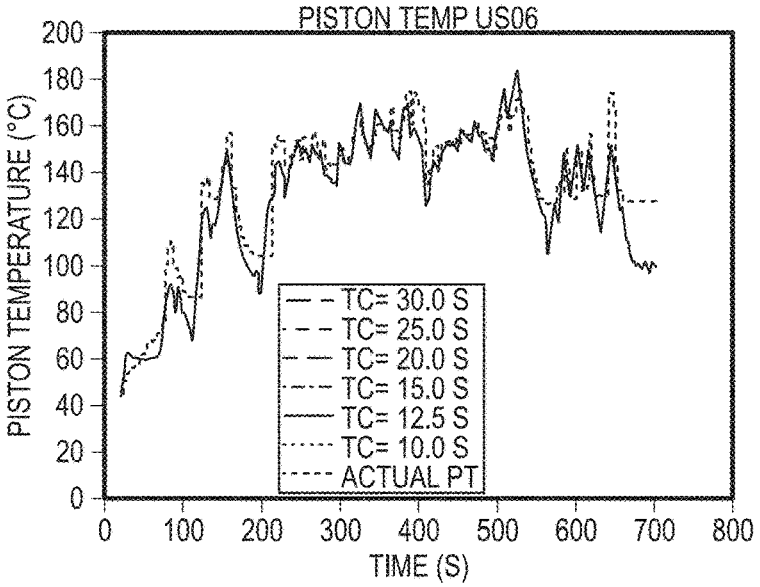

FIGS. 12A-12C show graphs of predicted piston temperature and actual piston temperature using various time constants as the engine was operated across two different EPA regulated transient test cycles, namely Federal Test Procedure 75 (FTP75) and US06 (an aggressive driving cycle). These figures include data derived from a dynamometer and as such are based on a specific engine configuration. Accordingly, measurements may vary based on the specific engine design utilized. The actual piston temperature values from experimentation are displayed. FIGS. 12A and 12B are substantially similar across different time scales. FIG. 12A is over a larger time of 3500 seconds (total duration of the FTP75), while FIG. 12B is up to 1700 seconds (first two phases of the FTP75). FIG. 12C is up to 700 seconds (total duration of US06). All three graphs show increasing values of piston temperature over time using a time constant of 12.5 seconds. Notably, the discrepancies in the predicted piston temperature and the actual piston temperature captured by the experimentation is due to the fact that the data acquisition system used in experimentation stops recording the data when the engine stops spinning. The engine used for the experimentation is equipped with engine start-stop technology. For example, the FTP 75 driving cycle, which simulates urban driving conditions, is a standardized driving cycle where engine idles are encountered throughout, leading to frequent engine stops following by engine starts. During these starts and stops, no actual piston temperature is recorded to compare to that predicted by the model. Thus, the actual piston temperature measurements flatline or may appear as an infinite value during these starts and stops in FIGS. 12A-12C. Between FIGS. 12A-12C, it is evident that the model accuracy increases as the engine stops decreases. For example, in FIG. 12A, the model and the actual piston temperatures disagree for substantial time periods when the engine is not operational.

Figure 13:
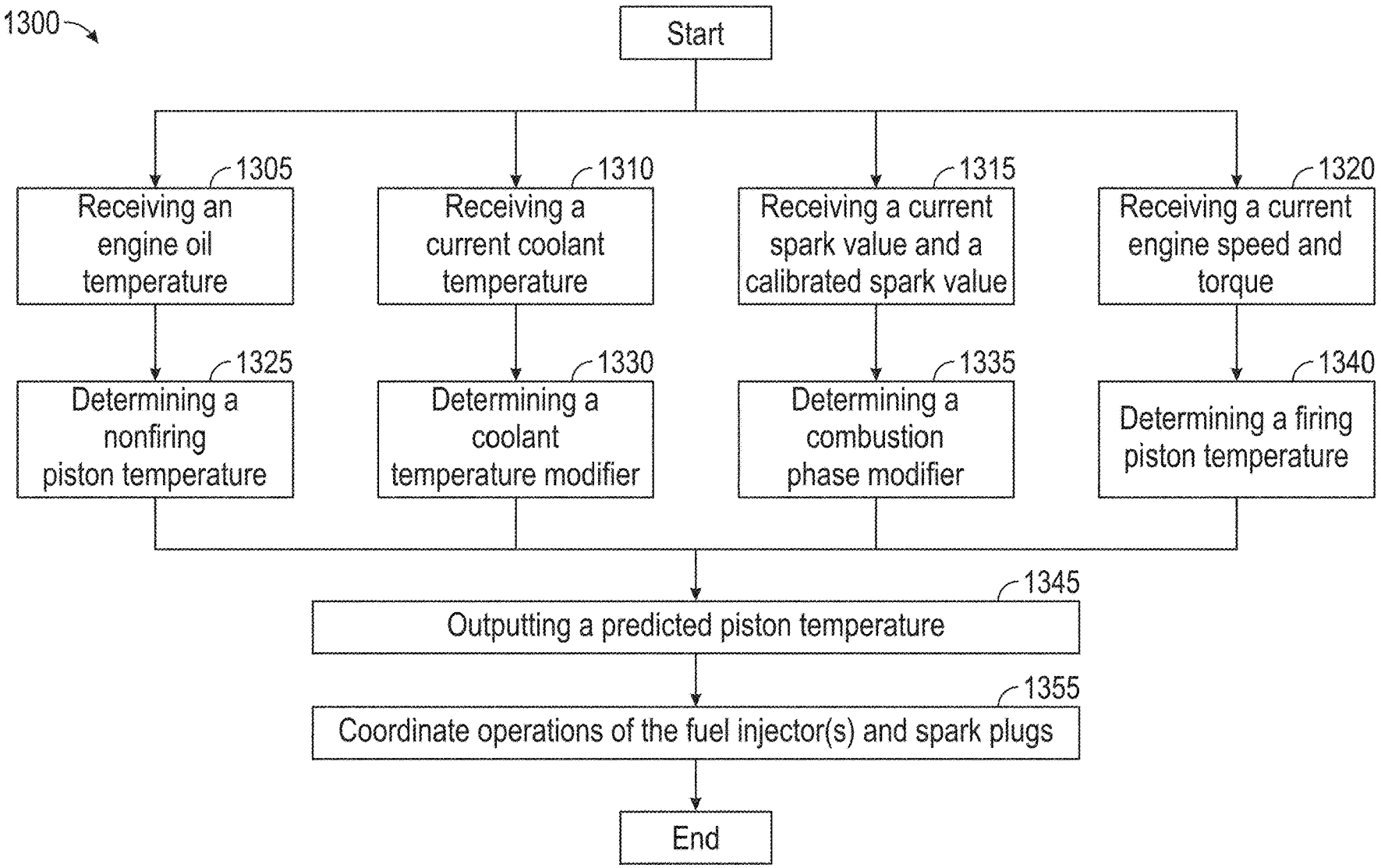
FIG. 13 is a process flow diagram in accordance with one or more embodiments disclosed herein.

FIG. 13 is a process flow diagram of the method 1300. Steps 1305, 1310, 1315, and 1320 occur in parallel rather than sequentially, though each step may start and end at different times relative to each other. In step 1305, the ECU receives an engine oil temperature from the engine oil temperature sensor 202. As the engine oil temperature sensor 202 is a measuring resistor sensor placed in the engine block (typically near the oil filter), the ECU receives a resistance measurement that is mathematically representative of the engine oil temperature and the ECU can achieve conversions based on the engine oil temperature sensor structure to determine the actual engine oil temperature. Once the engine oil temperature is received, in step 1325, the ECU determines a non-firing piston temperature. In step 1310, the ECU receives a current coolant temperature. Once the current coolant temperature is received, in step 1330, the ECU determines a coolant temperature modifier. In step 1315, the ECU receives a current spark value and a calibrated spark value. Once the current spark value and the calibrated spark value are received, in step 1335, the ECU determines a combustion phase modifier. In step 1320, the ECU receives a current engine speed and engine torque (based on a torque model). Once the current engine speed and torque are received, in step 1340, the ECU determines a firing piston temperature. In step 1345, once the ECU has determined all of these factors, the ECU outputs a predicted piston temperature. In step 1355, the ECU coordinates operations of the fuel injectors and spark plugs to optimize timing relative to predicted piston temperature. For example, high piston temperatures may indicate that the spark plug timing needs to be delayed to ensure that the mixture does not auto-ignite prior to spark generation, causing engine knock. Cold piston temperatures may indicate that the spark timing should be advanced to improve efficiency. Summarily, if the piston temperature is below a threshold, the spark is advanced by a predetermined amount until the next engine cycle where the piston temperature is re-evaluated. If the piston temperature is above the threshold, the spark is delayed to ensure that engine knock is avoided.

Embodiments of the present disclosure may provide at least one of the following advantages. By optimizing fuel injection timing in relation to piston temperature, emissions can be reduced. The present disclosure provides a fast-responding approximation for predicted piston temperature which accurately predicts the temperature of the surface of the piston crown to provide feedback to the ECU for optimizing injection strategy, thus reducing particulate emissions. Unlike other piston temperature models, this model is physics-based without use of a neural network or machine learning, and thus does not require extensive data inputs and contains relatively low error. Because of the simplicity and accuracy of the model, it is quickly responsive, which is essential for a real-time feedback loop. Additionally, the model in its entirety is able to account for compression, combustion, coolant temperature, and spark delay for knock control.

Furthermore, the compositions described herein may be free of any component, or composition not expressly recited or disclosed herein. Any method may lack any step not recited or disclosed herein. Likewise, the term "comprising" is considered synonymous with the term "including." Whenever a method, composition, element or group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Although only a few example embodiments have been described in detail above, those skilled in the art will readily appreciate that many modifications are possible in the example embodiments without materially departing from this invention. In addition, many modifications will be appreciated by those skilled in the art to adapt a particular instrument, situation, or material to embodiments of the disclosure without departing from the essential scope thereof. Accordingly, all such modifications are intended to be included within the scope of this disclosure as defined in the following claims.

What is claimed:

1. An engine, comprising:

a plurality of pistons configured to be actuated by combustion reactions within the engine;

a plurality of cylinders, each cylinder being configured to house a corresponding piston of the plurality of pistons and form a containment boundary for a corresponding combustion reaction of the combustion reactions;

at least one fuel injector configured to inject fuel into the plurality of cylinders, where the fuel is mixed with air disposed in the plurality of cylinders to form an air-fuel mixture;

a plurality of spark plugs, each spark plug being configured to ignite the air-fuel mixture in a corresponding cylinder to initiate the combustion reactions;

a plurality of piston cooling jets configured to spray engine oil; and an Electronic Control Unit (ECU) configured to:

receive an engine oil temperature;

receive a current coolant temperature;

receive a current spark value and a calibrated spark value for each spark plug of the plurality of spark plugs;

receive a current engine speed and a current engine torque during an associated combustion reaction of the combustion reactions;

determine a non-firing piston temperature for each piston from the engine oil temperature;

determine a coolant temperature modifier from the current coolant temperature;

determine a combustion phase modifier for each piston from the current spark value and the calibrated spark value;

determine a firing piston temperature for each piston from the current engine speed and the current engine torque output a predicted piston temperature for each piston based on the non-firing piston temperature, the firing piston temperature, the coolant temperature modifier, and the combustion phase modifier;

coordinate operations of the spark plugs and the at least one fuel injector based on the predicted piston temperature.

2. The engine of claim 1, wherein the at least one fuel injector comprises a plurality of fuel injectors, each fuel injector of the plurality of fuel injectors being positioned to inject a portion of the fuel into a first end of a corresponding cylinder of the plurality of cylinders.

3. The engine of claim 2, wherein the plurality of piston cooling jets is positioned to spray the engine oil towards a bottom of a piston crown, where the bottom of the piston crown is positioned at an opposite end of the corresponding cylinder from the first end of the corresponding cylinder.

4. The engine of claim 1, wherein the ECU is configured to subtract the current spark value from the calibrated spark value to form a differential spark value, and is further configured to determine the combustion phase modifier by multiplying the differential spark value and a spark coefficient.

5. The engine of claim 4, wherein the ECU is configured to determine the non-firing piston temperature by utilizing a regression model based on a correlation between the non-firing piston temperature and the engine oil temperature.

6. The engine of claim 5, wherein the ECU is configured to determine a differential coolant temperature by subtracting the current coolant temperature from a coolant temperature threshold, and is further configured to determine the coolant temperature modifier by multiplying the differential coolant temperature and a coolant temperature coefficient.

7. The engine of claim 6, further comprising:

an engine oil temperature sensor configured to determine the engine oil temperature;

a coolant temperature sensor configured to determine the current coolant temperature; and a crank shaft position sensor configured to determine an angle of rotation of a crank shaft of the engine.

8. The engine of claim 7, wherein the ECU is configured to:

receive the angle of rotation of the crank shaft from the crank shaft position sensor;

determine the current engine speed from the angle of rotation and the current engine torque; and retrieve the coolant temperature coefficient from a lookup table comprising inputs of engine speed values and engine torque values.

9. The engine of claim 7, wherein the ECU is configured to:

receive the angle of rotation of the crank shaft from the crank shaft position sensor;

determine the current engine speed from the angle of rotation and the current engine torque; and retrieve the spark coefficient from a lookup table comprising inputs of engine speed values and engine torque values.

10. The engine of claim 7, wherein the ECU is configured to:

retrieve the firing piston temperature from a lookup table comprising inputs of engine speed values and engine torque values.

11. The engine of claim 10, wherein each of the plurality of piston cooling jets comprises at least one oil squirter.

12. A method, comprising:

housing a plurality of pistons in a plurality of cylinders, where each cylinder houses a corresponding piston of the plurality of pistons and forms a containment boundary for a corresponding combustion reaction;

supplying air to the plurality of cylinders, which is mixed with air disposed in the plurality of cylinders;

injecting fuel into the plurality of cylinders with at least one fuel injector to mix with the air disposed in the plurality of cylinders to form an air-fuel mixture;

combusting the air-fuel mixture with a plurality of spark plugs situated within the plurality of cylinders;

spraying engine oil with a plurality of piston cooling jets onto an exterior of the plurality of cylinders;

receiving an engine oil temperature, a current coolant temperature, a current spark value for each spark plug, a calibrated spark value for each spark plug, a current engine speed, and a current engine torque with an Electronic Control Unit (ECU);

determining a non-firing piston temperature from the engine oil temperature with the ECU;

determining a coolant temperature modifier from the current coolant temperature with the ECU;

determining a combustion phase modifier from the current spark value and the calibrated spark value with the ECU;

determining a firing piston temperature from the current engine speed and the current engine torque with the ECU;

outputting a predicted piston temperature based on the non-firing piston temperature, the firing piston temperature, the coolant temperature modifier, and the combustion phase modifier with the ECU, and coordinating operations of the at least one fuel injectors and the spark plugs with the ECU based on the predicted piston temperature.

13. The method of claim 12, further comprising: subtracting the current spark value from the calibrated spark value to form a differential spark value, and multiplying the differential spark value by a spark coefficient to determine the combustion phase modifier.

14. The method of claim 12, further comprising: subtracting the current coolant temperature from a coolant temperature threshold to form a differential coolant temperature, and multiplying the differential coolant temperature by a coolant temperature coefficient to determine the coolant temperature modifier.

15. The method of claim 12, wherein outputting the predicted piston temperature further comprises adding the non-firing piston temperature to the firing piston temperature and subtracting the coolant temperature modifier and the combustion phase modifier therefrom.

16. The method of claim 12, wherein determining the firing piston temperature further comprises:

retrieving the firing piston temperature from a lookup table comprising inputs of engine speed values and engine torque values.

17. The method of claim 12, wherein determining the non-firing piston temperature further comprises utilizing a regression model based on a correlation between the non-firing piston temperature and the engine oil temperature.

18. The method of claim 13, wherein determining the spark coefficient comprises:

receiving a crank shaft position from a crank shaft position sensor;

determining the current engine speed and the current engine torque from the crank shaft position; and retrieving the spark coefficient from a lookup table comprising inputs of engine speed values and engine torque values.

19. The method of claim 14, wherein determining the coolant temperature coefficient comprises:

receiving a crank shaft position from a crank shaft position sensor;

determining the current engine speed and the current engine torque from the crank shaft position; and retrieving the coolant temperature coefficient from a lookup table comprising inputs of engine speed values and engine torque values.

20. The method of claim 17, wherein the regression model predicts the non-firing piston temperature during vehicle deceleration.

* * * * *